United States Patent [19]

Willhaus

[11] Patent Number: 4,536,628

[45] Date of Patent: Aug. 20, 1985

[54] PUSHBUTTON SWITCH ASSEMBLY WITH INTEGRATED LOCK-DOWN SWITCH

[75] Inventor: Werner Willhaus, Stuttgart, Fed. Rep. of Germany

[73] Assignee: International Standard Electric Corporation, New York, N.Y.

[21] Appl. No.: 598,947

[22] Filed: Apr. 11, 1984

[30] Foreign Application Priority Data

Apr. 23, 1983 [DE] Fed. Rep. of Germany ..... 3314772

[51] Int. Cl.[3] ..... H01H 9/28

[52] U.S. Cl. ..... 200/43.08; 200/5 A; 179/189 D

[58] Field of Search ..... 179/189 D, 90 D; 200/153 L, 42 R, 44, 5 A

[56] References Cited

U.S. PATENT DOCUMENTS

| | | | |
|---|---|---|---|
| 1,712,981 | 5/1929 | Clark et al. | 200/44 |
| 3,243,528 | 3/1966 | Brady | 200/153 L X |
| 4,303,809 | 12/1981 | Rubinstein et al. | 179/189 D |
| 4,403,315 | 9/1983 | Saito et al. | 200/5 A |

*Primary Examiner*—G. P. Tolin
*Assistant Examiner*—Morris Ginsburg
*Attorney, Agent, or Firm*—John T. O'Halloran; Thomas F. Meagher

[57] ABSTRACT

The present invention relates to a pushbutton switch assembly for use with telephone sets, having an integrated lock-down switch. With the aid of a rotatable trip cam of the lock-down switch, randomly one of several domes of a rubber-like switching mat of the pushbutton switch assembly can be actuated, so that certain operational conditions can be switched.

4 Claims, 4 Drawing Figures

PUSHBUTTON SWITCH ASSEMBLY WITH INTEGRATED LOCK-DOWN SWITCH

The present invention relates to a pushbutton switch assembly for use with telephone sets having a printed circuit provided with contacts and conductors and a switching mat of elastic material placed thereover, which comprises domes associated with pushbutton keys, and in the cavities of which the moving contacts are accommodated.

Such pushbutton switch assemblies with a printed circuit as the base for the fixed contacts, and a switching mat as the base for the moving contacts are already known, for example, from the German Published Patent Application (DE-OS) No. 30 33 134. The switching mat consists of rubber or of a rubber-elastic plastics material and is provided with dome-like archings which are associated with the pushbutton keys. Inside the arching there is positioned a moving contact which, upon depressing a pushbutton key, comes in touch with the corresponding fixed contact on the printed circuit.

With modern types of telephone sets, such pushbutton switch assemblies employing switching mats, are used to an increasing extent as pushbutton dialling units. Moreover, in the case of intercommunication and secretarial systems, for switching the operational states, such as for programming service features or blocking toll line authorizations, there is required an additional lock-down switch. This lock-down switch is a separate structural unit which consists of a lock cylinder with a removable key, with a cam capable of rotating about the cylinder axis, cooperating with contact springs, being connected to the lock cylinder. All parts are accommodated in a cylindrical housing of plastics material which is either screwed to the chassis of the telephone set, or can be attached thereto in a form-fit connection (German Utility Model (DE-GM) No. 75 28 008).

It is the object of the present invention to integrate the lock-down switch into the pushbutton switch assembly. This object is achieved by employment of a lock-down switch, whose lock cylinder comprises a rotatable trip cam, disposed in such a way above the switching mat that a dome becomes operable upon rotation of the trip cam. By the configuration according to the invention there is attained the advantage that a separate lock-down switch group becomes superfluous. The space required for this and the wiring can be used otherwise. Both the construction and the assembly of the telephone set are more simple and inexpensive than with conventional types. Also the retrofitting can be carried out easily because no soldering work is required. The wiring is already provided for in a printed circuit.

Figure 1:
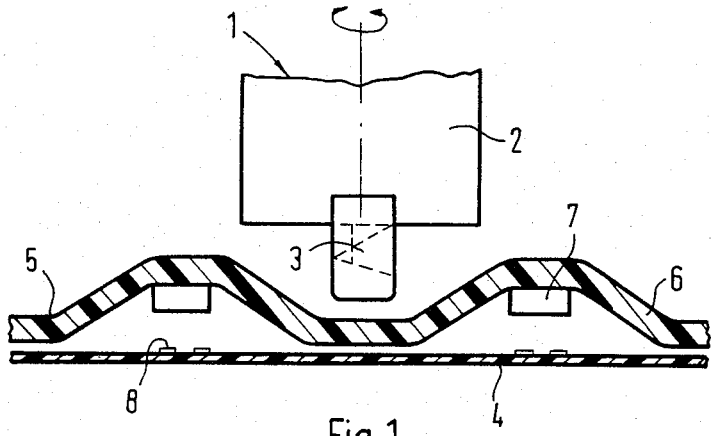
Figure 2:
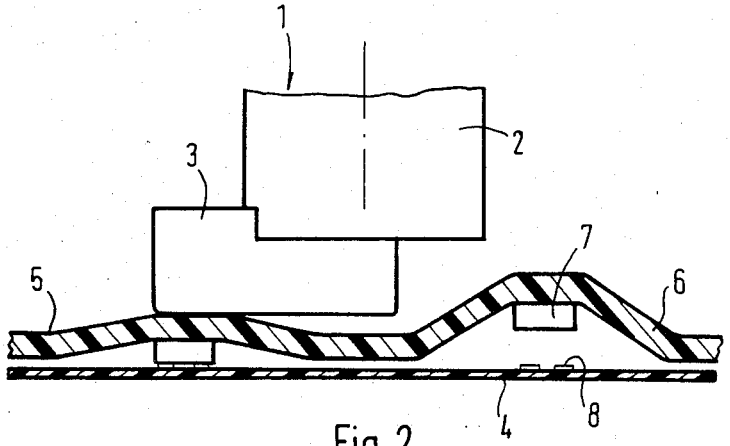
Figure 3:
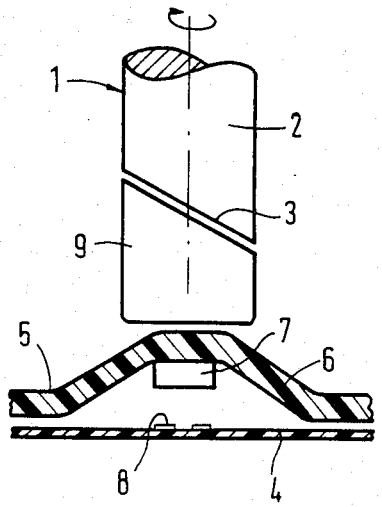
Figure 4:
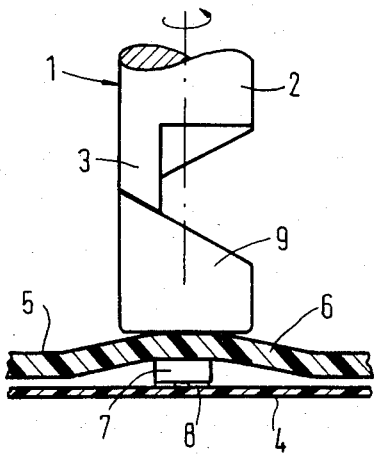

The invention will now be described in greater detail with reference to examples of embodiments shown in FIGS. 1 to 4 of the accompanying drawings, in which:

FIG. 1 shows a lock-down switch according to the invention, in a neutral position between two switching-mat domes, in a cross-sectional view, FIG. 2 shows the same lock-down switch as in FIG. 1, but in the actuated position above one dome of the switching mat, FIG. 3 shows a modified design of the lock-down switch in the non-actuated position above a dome of the switching mat, and FIG. 4 shows the lock-down switch of FIG. 3 in the actuated position.

In the pushbutton switch assembly as shown in FIGS. 1 and 2, a switching mat 5 having dome-shaped convexities 6 is disposed over a printed circuit 4 having the fixed contacts and conductors 8. The printed circuit 4 is formed by a printed circuit board or a conductor foil. The switching mat 5 consists of an elastic, rubber-like plastics material.

Inside the domes 6 of the switching mat 5 there are the moving contacts 7 which cooperate with the fixed contacts 8 on the printed circuit 4. When the assembly is used with a pushbutton dialling unit for telephone sets, the domes are actuated by pushbuttons placed respectively above them, but not shown in the accompanying drawings.

Between respectively two domes 6 there is disposed one lock-down switch 1 whose lock cylinder 2 is provided at its lower end with a rotatable trip cam 3 formed by a wing-type attachment of the lock cylinder 2 (as seen in FIGS. 1 and 2). The rotation of both the lock cylinder and its trip cam is effected, in the usual way, with the aid of a (not shown) key. In FIG. 1, the trip cam 3 is shown in its neutral center position between two domes 6 of the switching mat 5. As is indicated by the double arrow, it can be rotated in both directions about its axis. In FIG. 2, it is shown to have been turned to the left and to have depressed in the course of this, the left-hand dome 6, so that the contact 7 thereof comes in touch with the contact 8 on the printed circuit. The domes 6 associated with the lock-down switch are provided for in addition to the pushbutton-actuated domes on the switching mat.

It is sufficient to provide two domes, but equally well also four domes may be disposed in such a way around the lock cylinder as to become operable by the trip cam 3 thereof. In cases where the lock-down switch 1 is required not at all, there is merely omitted the lock cylinder, and the corresponding opening in the control panel is closed by means of a (not shown) dummy plug. Conversely, in retrofitting the telephone set, the dummy plug is replaced by a lock-down switch.

In the type of embodiment as shown in FIG. 3 and 4, unlike in the previously described type of embodiment, the lock-down switch 1 is disposed coaxially above one dome 6 of the switching mat 5. Accordingly, only one dome can be actuated.

In this case, the trip cam 3 of the lock cylinder 2 consists of a bevel of the lower end of the rotatable portion of the lock-dowwn switch. This cam 3 is opposed by the complimentarily bevelled end of a coaxially disposed plunger 9 which is supported capable of being moved in the axial direction only. If now, the cam 3 is turned from the position as shown in FIG. 3 into the position as shown in FIG. 4, the plunger 9, in accordance with the inclination of the bevels on both the cam and the plunger, is moved downwardly towards the dome 6, causing the latter to be depressed, so that the contacts 7 and 8 come in touch with one another. Upon turning back the lock-down switch 1, the plunger 9 reassumes its normal position.

I claim:

1. A pushbutton switch assembly, comprising a printed circuit provided with contacts and conductors and a switching mat of elastic material placed thereover, which comprises domes associated with pushbutton keys, and in the cavities of which the moving contacts are accommodated, wherein a lock-down switch, whose lock cylinder comprises a rotatable trip cam, is integrated into said pushbutton switch assembly · and is disposed in such a way above the switching mat that a dome becomes operable upon rotation of the trip cam.

2. A pushbutton switch assembly as claimed in claim 1, wherein said trip cam is formed by the bevelled end of said lock cylinder and acts upon the oppositely complementarily bevelled end of a coaxially disposed, axially displaceable plunger whose other end actuates said dome.

3. A pushbutton switch assembly as claimed in claim 1, wherein said trip cam is formed by a wing-type attachment of said lock cylinder, which acts upon said dome.

4. A pushbutton switch assembly as claimed in claim 3, wherein said lock-down switch is in such a way disposed between said domes that by said trip cam each time one of at least two neighbouring domes is capable of being actuated.

* * * * *